US010504636B2

(12) United States Patent
Oya

(10) Patent No.: US 10,504,636 B2
(45) Date of Patent: Dec. 10, 2019

(54) INSULATED WIRE, COIL AND ELECTRIC OR ELECTRONIC EQUIPMENT

(71) Applicants: FURUKAWA ELECTRIC CO., LTD., Tokyo (JP); FURUKAWA MAGNET WIRE CO., LTD., Tokyo (JP)

(72) Inventor: Makoto Oya, Tokyo (JP)

(73) Assignees: FURUKAWA ELECTRIC CO., LTD., Tokyo (JP); FURUKAWA MAGNET WIRE CO., LTD., Tokyo (JP)

( * ) Notice: Subject to any disclaimer, the term of this patent is extended or adjusted under 35 U.S.C. 154(b) by 0 days.

(21) Appl. No.: 16/001,205

(22) Filed: Jun. 6, 2018

(65) Prior Publication Data

US 2018/0286532 A1 Oct. 4, 2018

Related U.S. Application Data

(63) Continuation of application No. PCT/JP2016/085783, filed on Dec. 1, 2016.

(30) Foreign Application Priority Data

Dec. 8, 2015 (JP) ..... 2015-239764

(51) Int. Cl.
*H01B 7/02* (2006.01)
*H01F 5/06* (2006.01)
(Continued)

(52) U.S. Cl.
CPC ..... *H01B 7/0216* (2013.01); *H01B 3/30* (2013.01); *H01B 3/301* (2013.01); *H01B 3/306* (2013.01);
(Continued)

(58) Field of Classification Search
CPC ..... H01B 7/0208; H01B 7/08
(Continued)

(56) References Cited

U.S. PATENT DOCUMENTS

2013/0000951 A1* 1/2013 Honda ..... H01B 3/308 174/120 SR
2013/0161065 A1* 6/2013 Honda ..... H01B 3/30 174/120 SR
(Continued)

FOREIGN PATENT DOCUMENTS

JP 2012-233123 A 11/2012
JP 2013-101759 A 5/2013
JP 2015-133218 A 7/2015

OTHER PUBLICATIONS

International Search Report (PCT/ISA/210) issued in PCT/JP2016/085783, dated Dec. 27, 2016.
(Continued)

*Primary Examiner* — Chau N Nguyen
(74) *Attorney, Agent, or Firm* — Birch, Stewart, Kolasch & Birch, LLP

(57) ABSTRACT

An insulated wire, containing a conductor, an adhesion layer provided in direct contact with the conductor, and an insulating layer composed of a polyimide resin, which is provided on the adhesion layer, in which, in the adhesion layer, the content rate of a total formula weight of an imide structure represented by Formula (a) in a polyimide resin skeleton is 27% or more and 33% or less; and, in the polyimide resin of the insulating layer, the content rate of a total formula weight of the imide structure in a polyimide resin skeleton is more than 27% and 37% or less:
(Continued)

1: Insulated wire
11: Conductor
21: Adhesion layer
22: Insulating layer
22a: Insulating layer 1
22b: Insulating layer 2

Formula (a)

a coil; and
an electric or electronic equipment.

7 Claims, 4 Drawing Sheets

(51) Int. Cl.
*H01B 3/30* (2006.01)
*H01B 3/42* (2006.01)

(52) U.S. Cl.
CPC ..... *H01B 3/427* (2013.01); *H01B 7/02* (2013.01); *H01F 5/06* (2013.01)

(58) Field of Classification Search
USPC ..... 174/120 R, 117 FF
See application file for complete search history.

(56) References Cited

U.S. PATENT DOCUMENTS

2015/0221412 A1* 8/2015 Caudill ..... H01B 3/427
428/339
2016/0307667 A1 10/2016 Fukuda et al.

OTHER PUBLICATIONS

Extended European Search Report dated Jul. 3, 2019, for European Patent Application No. 16872891.3.

* cited by examiner

{FIG. 1}
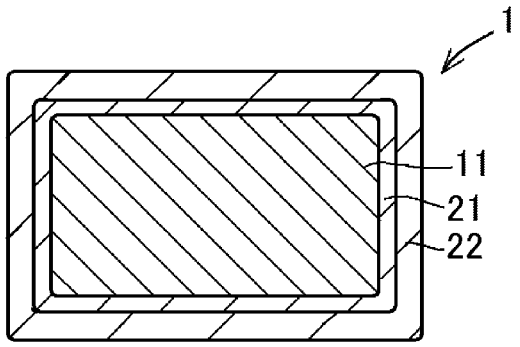
{FIG. 2}
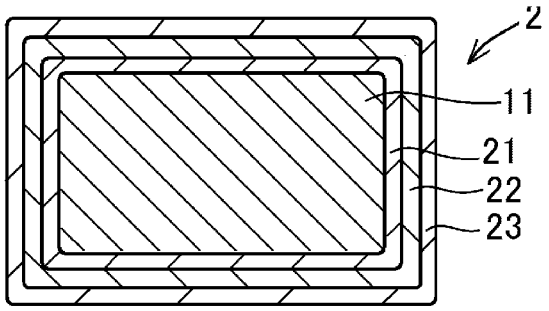
{FIG. 3}
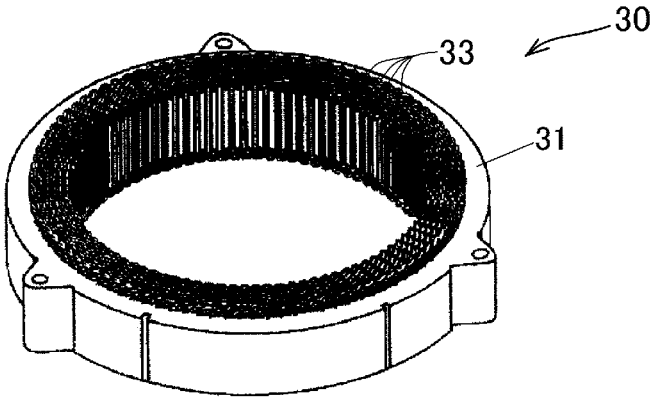

{FIG. 4}
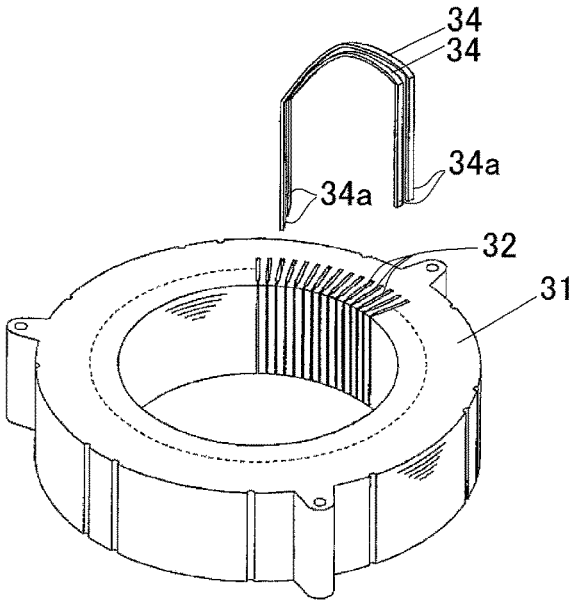

1: Insulated wire
11: Conductor
21: Adhesion layer
22: Insulating layer
22a: Insulating layer 1
22b: Insulating layer 2

1: Insulated wire
11: Conductor
21: Adhesion layer
22: Insulating layer
22a: Insulating layer 1
22b: Insulating layer 2
22c: Insulating layer 3

INSULATED WIRE, COIL AND ELECTRIC OR ELECTRONIC EQUIPMENT

CROSS-REFERENCE TO RELATED APPLICATIONS

This application is a Continuation of PCT International Application No. PCT/JP2016/085783 filed on Nov. 7, 2016, which claims priority under 35 U.S.C. § 119 (a) to Japanese Patent Application No. 2015-239764 filed in Japan on Dec. 8, 2015. Each of the above applications is hereby expressly incorporated by reference, in its entirety, into the present application.

FIELD OF THE INVENTION

The present invention relates to an insulated wire, a coil, and an electric or electronic equipment.

BACKGROUND OF THE INVENTION

It has become demanded to improving various performances, such as heat resistance, mechanical properties, chemical property, electrical property and reliability, in the electronic or electrical equipment developed in recent years, as compared to the conventional electronic or electrical equipment. Polyimide and the like have been used for a film material of the insulated wire.

Advance of electrical equipment represented by motors or transformers has been progressed resulting in size reduction and improved performance. Thus, it becomes usual in many cases that insulated wires are used in such a way that the insulated wires are processed by winding (also referred to as coil processing or bending processing) to winding wires (coils) and they are pushed into a quite small space to pack. Specifically, it is no exaggeration to say that the performance of a rotating electric machine, such as a motor, is determined by how many coils produced by coil working the insulated wires can be held in a stator slot. As a result, a mechanical stress applied to the insulated wire become large, and concern is generation of insulation failure portion due to a film defect reaching the conductor.

In this case, when an electric current passes through an insulated wire assembled into electrical equipment, the insulated wire reaches a high temperature by heat generated. It is known that, in the insulating film, a film defect becomes easy to generate by a linear expansion difference at the high temperature, or by a thermal shrinkage due to a thermal deterioration. Moreover, a mechanical stress acts on or remains in the insulated wire during winding processing and also even after winding processing, and the cracking is caused in several cases. In particular, in a case where a major stress of a recent motor or the like is given to the insulated wire, this tendency is thought to be high.

Furthermore, when a thermoplastic resin layer is formed as the outermost layer by extrusion molding, a stress acted thereon during molding remains in the film resin layer even after the extrusion molding in several cases, and the cracking caused by the above-described thermal shrinkage stress and mechanical stress is induced in several cases.

On the other hand, from the past, it has been considered that if adhesion strength between an enamel-baking layer and a conductor, and adhesion strength within the enamel baking layer are increased, a processing resistance gets higher. Therefore, an attempt to enhance this adhesion strength has been made. Examples of those in which interlayer adhesion strength has been given to the enamel-baking layer include a magnet wire described in Patent Literature 1. However, in this method, because the excessively increased interlayer adhesion strength is set in order to prevent occurrence of delamination, there is a possibility that in a case where a defect has generated in a film, the cracks occur all over the film. Further, evaluation of a relatively thin enamel was conducted in this method, and there was a concern that, when the film is thickly formed in order to satisfy a highly required partial discharge inception voltage (hereinafter, referred to as PDIV) in recent years, the film cannot stand the stress given to the outer film by the bending.

Further, in a similar way, a technique of improving a PDIV property (corona resistance) for the polyimide by increasing interlayer adhesion strength, thereby to make a film thicker is also proposed (for example, see Patent Literature 2). However, even the technique described in the Patent Literature 2, because the interlayer adhesion strength is excessively increased, a film has a construction by which, when a defect generates in the film, the cracks are easy to occur all over the film.

CITATION LIST

Patent Literatures

Patent Literature 1: JP-A-2012-233123 ("JP-A" means unexamined published Japanese patent application)
Patent Literature 2: JP-A-2013-101759

SUMMARY OF THE INVENTION

Technical Problem

The conventional insulated wires have been designed so that layers are rigidly adhered or bonded through each resin layer of the film. Therefore, when the breaking generated in any of the film-constructing resin layers, the broken point as a point of origin sometimes happened to develop into a major defect throughout the film. If the defect of the film reaches the conductor, properties of the insulating film, eventually insulation performance of the insulated wire, are deteriorated. If such a defect of the film reaching the conductor generates in a welding-processed insulated wire, electric or electronic equipment is prevented from exhibiting a desired performance.

Accordingly, the present invention is contemplated for providing an insulated wire in which, even in a case where a major processing stress or heating is applied thereto, an insulation defect that can generate an insulation failure in the film is hard to occur, and which has high reliability; and for providing a coil and electric or electronic equipment, in each of which this insulated wire is used.

In the present invention, "high reliability" means that the insulated wire holds properties of the insulated wire, particularly the insulation performance within a tolerable range.

Solution to Problem

The present inventors diligently continued to conduct study on cracks reaching a conductor in a multilayer insulated covering. As a result, the present inventors found that control of interlayer adhesion of the multilayer wire to the covering layers constitution is related with the cracks reaching the conductor in the multilayer insulated covering. As a result of advancing further studies, the present inventors found that at least occurrence of cracks reaching the conductor can be prevented by giving regularity to interlayer adhesion properties among each of resin layers including adhesion strength on the conductor, and by changing a blending ratio of the polyimide resin in these layers. The present inventors also found that an effect of preventing occurrence of cracks reaching the conductor is further enhanced, preferably, by selecting layer constitution of the multilayer insulated covering, a kind or properties of a resin that forms each layer and the like.

The present invention has been made based on those findings.

In other words, the above-described problems of the present invention are solved by the following means.

(1) An insulated wire, containing:

a conductor;

an adhesion layer provided in direct contact with the conductor; and an insulating layer composed of a polyimide resin, which is provided on the adhesion layer, wherein, in the adhesion layer, the content rate of a total formula weight of an imide structure represented by Formula (a) in a polyimide resin skeleton is 27% or more and 33% or less; and wherein, in the polyimide resin of the insulating layer, the content rate of a total formula weight of the imide structure in a polyimide resin skeleton is more than 27% and 37% or less:

Formula (a)

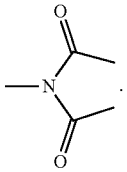

(2) The insulated wire described in the above item (1), wherein a difference in the content rate of the total formula weight of the imide structure between the adhesion layer and the insulating layer is from 4.0 to 10.0%.

(3) The insulated wire described in the above item (1) or (2), wherein a difference in the content rate of the total formula weight of the imide structure between the adhesion layer and the insulating layer is from 4.0 to 10.0%, and the content rate of the total formula weight of the insulating layer is greater than the adhesion layer.

(4) The insulated wire described in any one of the above items (1) to (3), wherein the insulating layer is composed of two or more layers, and a difference in the content rate of the total formula weight of the imide structure between insulating layers adjacent to each other is from 4.0 to 10.0%.

(5) The insulated wire described in any one of the above items (1) to (4), wherein the polyimide resin has a partial structure represented by Formula (1):

Formula (1)

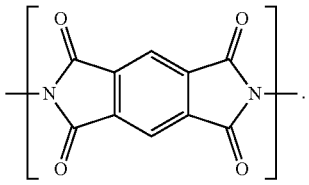

(6) The insulated wire described in any one of the above items (1) to (5), further containing a reinforcing insulating layer composed of a thermoplastic resin, wherein the thermoplastic resin contains at least one kind of resin selected from a polyetherether ketone resin and a polyphenylene sulfide resin.

(7) A coil, which is obtained by winding working the insulated wire described in any one of the above items (1) to (6).

(8) An electric or electronic equipment, containing the coil described in the above item (7).

In the description of the present invention, any numerical expressions in a style of " . . . to . . . " will be used to indicate a range including the lower and upper limits represented by the numerals given before and after "to", respectively.

In the present invention, in the cross-sectional shape perpendicular to the longitudinal direction of the insulated wire, the shape of the insulated wire including a conductor and an enamel layer may be sometimes referred to simply as the cross-sectional shape. Regarding the cross-sectional shape in the present invention, not only a cut plane simply has a particular shape, but also this cross-sectional shape is continuously connecting toward the longitudinal direction of the entire insulated wire. Therefore, this means that, with respect to any portion in the longitudinal direction of the insulated wire, the cross-sectional shapes perpendicular to this direction are all the same, unless otherwise indicated.

Effects of Invention

According to the present invention, it is possible to provide an insulated wire in which, even in a case where a major processing stress or heating is applied thereto, an insulation defect that can generate an insulation failure in the film is hard to occur, and which has high reliability; and a coil and electric or electronic equipment, in each of which this insulated wire is used.

Other and further objects, features and advantages of the invention will appear more fully from the following description, appropriately referring to the accompanying drawings.

BRIEF DESCRIPTION OF DRAWINGS

FIG. 1 is a schematic cross-sectional view showing a preferred embodiment of the insulated wire of the present invention.

FIG. 2 is a schematic cross-sectional view showing another preferred embodiment of the insulated wire of the present invention.

FIG. 3 is a schematic perspective view showing a preferable embodiment of the stator used in the electric or electronic equipment of the present invention.

FIG. 4 is a schematic exploded perspective view showing a preferable embodiment of the stator used in the electric or electronic equipment of the present invention.

DESCRIPTION OF EMBODIMENTS

<<Insulated Wire>>

Figure 5A:
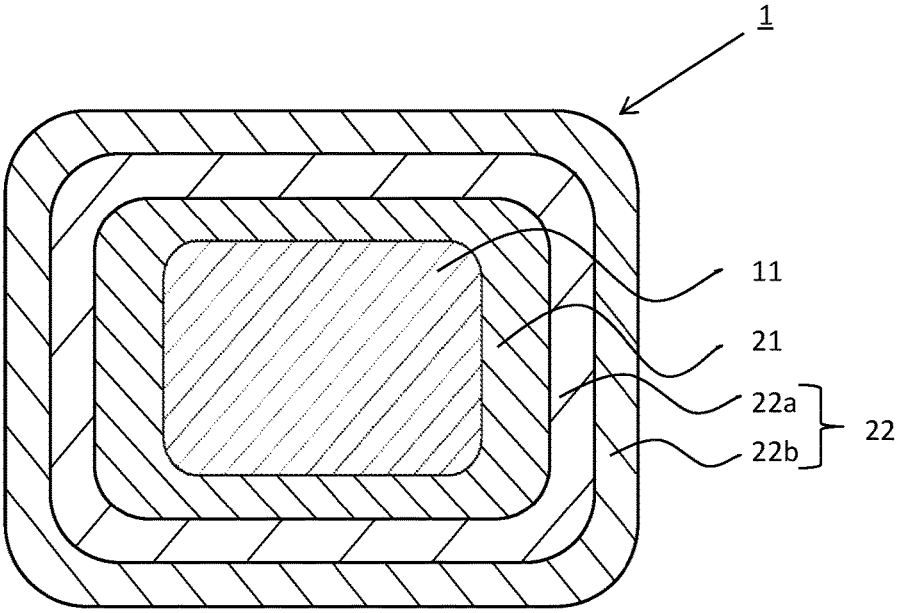
FIG. 5A and FIG. 5B are schematic cross-sectional views showing a preferred embodiment of the insulated wire of the present invention.

The insulated wire of the present invention has an adhesion layer provided in direct contact with a conductor, and has an insulating layer provided on said adhesion layer.

The above-described adhesion layer and insulating layer are each composed of a thermosetting resin. The insulating layer may be a single layer, or may be a laminate of plural layers. Further, the insulated wire may have a reinforcing insulating layer composed of a thermoplastic resin, on the above-described insulating layer.

Note that the above-described adhesion layer and insulating layer each of which is composed of a thermosetting resin are also called as the enamel layer.

<Conductor>

As the conductor used in the present invention, use may be made of any conductor that is usually used in insulated wires and examples thereof include a metal conductor such as a copper wire and an aluminum wire. The conductor used in the present invention is preferably a copper conductor, and the copper to be used is preferably a low-oxygen copper whose oxygen content is 30 ppm or less, and furthermore preferably a low-oxygen copper whose oxygen content is 20 ppm or less or oxygen-free copper. In a case where the conductor is melted by heat for the purpose of welding if the oxygen content is 30 ppm or less, voids caused by contained oxygen are not occurred at a welded portion, the deterioration of the electrical resistance of the welded portion can be prevented, and the strength of the welded portion can be secured.

Further, in a case where the conductor is aluminum, based on a consideration of a required mechanical strength, various aluminum alloys may be used depending on the intended use. For example, for such a use as a rotating electrical machine, it is preferred to use a 99.00% or more-grade pure aluminum by which a high current value can be obtained.

A cross-sectional shape of the conductor is determined according to an application, and thus any shapes, such as a circular shape, a rectangular shape (rectangular) or a hexagonal shape, may be utilized. For example, for the application, such as the rotating electrical machine, a rectangular conductor is preferable in view of a capability of keeping high conductor occupancy in the slot of the stator core.

A size of the conductor is determined according to the application, and is not particularly designated. In the case of a round conductor, the size is preferably 0.3 to 3.0 mm, and more preferably 0.4 to 2.7 mm in terms of a diameter. In the case of a rectangular conductor, a width (long side) as a length of one side is preferably 1.0 to 5.0 mm, and more preferably 1.4 to 4.0 mm, and a thickness (short side) is preferably 0.4 to 3.0 mm, and more preferably 0.5 to 2.5 mm. However, a range of the conductor size in which advantageous effects of the present invention are obtained is not limited thereto. Moreover, in the case of the rectangular conductor, although the shape is also different according to the application, a cross-sectional rectangular (quadrate) is more general than a cross-sectional square. Moreover, in the case of the rectangular conductor, when the application is the rotating electrical machine, for chamfering (curvature radius r) in four corners in a conductor cross section, r is preferably smaller from a viewpoint of keeping the high conductor occupancy in the slot of the stator core. From a viewpoint of suppressing a phenomenon of partial discharge by concentration of an electric field on the four corners, r is preferably larger. Thus, the curvature radius r is preferably 0.6 mm or less, and more preferably 0.2 to 0.4 mm. However, the range in which the advantageous effects of the present invention are obtained is not limited thereto.

<Adhesion Layer>

The adhesion layer is a thermosetting resin layer provided on the outer periphery of a conductor so as to be in direct contact with the conductor.

Note that the adhesion layer and the insulating layer are each a thermosetting resin layer composed of a thermosetting resin, and are each formed by coating and baking steps of coating and baking a thermosetting resin varnish, and ordinarily a thermosetting resin layer having an aimed thickness is formed by repeating the coating and the baking.

In the present invention, even if the coating and the baking of an identical thermosetting resin varnish is repeated in order to simply adjust a thickness of the layer, these coatings are counted as an identical layer, in other words, as a single layer.

(Thermosetting Resin)

In the present invention, as a resin composing an adhesion layer, a thermosetting polyimide (PI) resin is used.

As the polyimide (PI) resin to be used, a single polyimide (PI) resin may be used, or a plurality of polyimide (PI) resins may be used in combination. However, it is preferable to use a single polyimide (PI) resin.

In particular, in the polyimide (PI) resin to be used in the present invention, the content rate of a total formula weight of an imide structure represented by Formula (a) in a polyimide resin skeleton is 27% or more and 33% or less.

Formula (a)

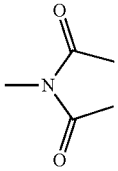

The formula weight of the above-described imide structure is 70.03, since the structure has the composition of $C_2N_1O_2$ in which the carbon atom has an atomic weight of 12.01, the nitrogen atom has an atomic weight of 14.01, and the oxygen atom has an atomic weight of 16.00. The content rate of a total formula weight of the imide structure represented by Formula (a) existing in a polyimide resin skeleton, for example, in a case of one molecular polyimide resin, is the content rate of a total formula weight of the above-described imide structure which occupies in the molecular weight of one molecule of the polyimide resin and, in a case of a mixture of two or more molecules, is the content rate of an average total formula weight of the above-described imide structure which occupies in the weight-average molecular weight.

Specifically, for example, in the case of the polyimide resin obtained from a pyromellitic acid dianhydride (PMDA) and 4,4'-diaminodiphenyl ether (4,4'-ODA), the polyimide resin is composed of the following recurring unit.

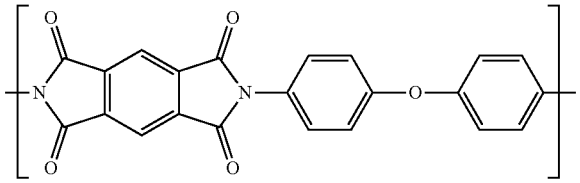

PMDA-ODA

In this case, even if the polyimide resin is a mixture of molecules having a different molecular weight from each other, said polyimide resin is only composed of the above-described single recurring unit. Accordingly, without having to consider a molecular weight of one molecule, or a weight-average molecular weight in the case of a mixture of two or more molecules, the content rate of a total formula weight of the above-described imide structure is calculated only from the above-described single recurring unit.

More specifically, since the imide structure represented by Formula (a) in the above-described polyimide resin is 2, a total formula weight is calculated to be 140.06. Since the construction of the one recurring unit is $C_{22}H_{10}N_2O_5$, its formula weight is calculated to be 382.34. Accordingly, the content rate of a total formula weight of the above-described imide structure is calculated to be (140.03÷382.34)×100=36.62477 or about 36.6%.

The content rate of a total formula weight of the above-described imide structure can be adjusted by the kind of and the combination of a carboxylic acid anhydride and an amine compound, each of which is used as a synthetic raw material.

In the present invention, the content rate of a total formula weight of the above-described imide structure is 27% or more and 33% or less. If the content rate is less than 27%, the solvent resistance and the heat resistance become insufficient, whereas if it is more than 33%, a defect at the side of the conductor occurs.

The polyimide (PI) resin is synthesized from a tetracarboxylic acid dianhydride and a diamine compound. In a case of using a varnish containing the carboxylic acid dianhydride and the diamine compound, or a resin varnish containing a polyimide precursor, and then subjecting the varnish to a heat curing in a baking furnace, the content rate of a total formula weight of the above-described imide structure is a value calculated from the polyimide (PI) resin after subjecting it to the heat curing in the baking furnace.

Examples of the tetracarboxylic acid dianhydride include 3,3',4,4'-biphenyl tetracarboxylic acid dianhydride (BPDA), 3,3',4,4'-benzophenone tetracarboxylic acid dianhydride (BTDA), 3,3',4,4'-biphenylether tetracarboxylic acid dianhydride (OPDA), 3,3',4,4'-diphenylsulfone tetracarboxylic acid dianhydride (DSDA), bicyclo(2,2,2)-octo-7-ene-2,3,5,6-tetracarboxylic acid dianhydride (BCD), 1,2,4,5-cyclohexane tetracarboxylic acid dianhydride (H-PMDA), pyromellitic acid dianhydride (PMDA), 2,2-bis(3,4-dicarboxypheny) hexafluoro propane dianhydride (6FDA), 5-(2,5-dioxotetrahydrofuryl)-3-methyl-3-cyclohexene-1,2-dicarboxylic acid anhydride (CP), 4,4'-[propane-2,2-diylbis(1,4-phenyleneoxy)]diphthalic acid dianhydride (BISDA), and 4,4'-oxydiphthalic acid anhydride (ODPA).

In the present invention, the polyimide (PI) resin is preferably a polyimide (PI) resin having a partial structure represented by Formula (1).

Formula (1)

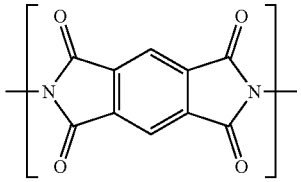

Examples of the diamine compound include p-phenylenediamine, m-phenylenediamine, siliconediamine, bis(3-aminopropyl)ether ethane, 3,3'-diamino-4,4'-dihydroxydiphenylsulfone (SO2-HOAB), 4,4'-diamino-3,3'-dihydroxybiphenyl (HOAB), 4,4'-diaminobiphenyl ether (4,4'-ODA), 3,3'-diaminobiphenyl ether (3,3'-ODA), 2,2-bis[4-(4-aminophenoxy)phenyl] hexafluoropropane (HOCF3AB), siloxanediamine, bis(3-aminopropyl)ether ethane, N,N-bis(3-aminopropyl)ether, 1,4-bis(3-aminopropyl)piperazine, isophoronediamine, 1,3-bis(aminomethyl)cyclohexane, 3,3'-dimethyl-4,4'-diaminodicylohexylmethane, 4,4'-methylenebis(cyclohexylamine), 4,4'-diaminodiphenyl ether (DDE), 3,4'-diaminodiphenyl ether (m-DDE), 3,3'-diaminodiphenyl ether, 4,4'-diamino-diphenylsulfone (p-DDS), 3,4'-diamino-diphenylsulfone, 3,3'-diamino-diphenylsulfone, 2,4'-diaminodiphenyl ether, 1,3-bis(4-aminophenoxy)benzene (m-TPE), 1,3-bis(3-aminophenoxy)benzene (APB), 2,2-bis[4-(4-aminophenoxy)phenyl]propane (BAPP), 2,2-bis[4-(4-aminophenoxy)phenyl]hexafluoropropane (HF-BAPP), bis[4-(4-aminophenoxy)phenyl]sulfone (p-BAPS), bis[4-(3-aminophenoxy)phenyl]sulfone (m-BAPS), 4,4'-bis(4-aminophenoxy)biphenyl (BAPB), 1,4-bis(4-aminophenoxy)benzene (p-TPE), 4,4'-diaminodiphenylsulfide (ASD), 3,4'-diaminodiphenylsulfide, 3,3'-diaminodiphenylsulfide, 3,3'-diamino-4,4'-dihydorxydipheylsulfone, 2,4-diaminotoluene (DAT), 2,5-diaminotoluene, 3,5-diaminobenzoic acid (DABz), 2,6-diaminopyridine (DAPy), 4,4'-diamino-3,3'-dimethoxy-biphenyl (CH3OAB), 4,4'-diamino-3,3'-dimethylbiphenyl (CH3AB), and 9,9'-bis(4-aminophenyl)fluorene (FDA).

As the diamine compound by which the polyimide (PI) resin is synthesized, one kind or more than one kind thereof may be used.

In the present invention, a compound selected from the group consisting of 4,4'-diaminobiphenyl ether (4,4'-ODA), 3,3'-diaminodiphenyl ether (3,3'-ODA), 2,2-bis[4-(4-aminophenoxy)phenyl]propane (BAPP), 1,4-bis(4-aminophenoxy) benzene (p-TPE), and 1,3-bis(4-aminophenoxy)benzene (m-TPE) is preferred.

The weight-average molecular weight of the polyimide resin (PI) is preferably 5,000 to 100,000, more preferably 10,000 to 50,000.

Herein, the weight-average molecular weight is a value measured as the polystyrene-equivalent molecular weight by means of GPC (Gel Permeation Chromatography).

(Additives)

To the adhesion layer, additives such as trialkyl amines, alkoxylated melamine resins, and thiol-series compounds may be added to enhance adhesion strength between the adhesion layer and the conductor.

Preferable examples of the trialkyl amines include trialkyl amines of lower alkyl groups such as trimethyl amine, triethyl amine, tripropyl amine, tributylamine, and the like. Among these, trimethyl amine and triethyl amine are preferred in terms of flexibility and adhesion property.

As the alkoxylated melamine resins, for example, the use can be made of melamine resins substituted with a lower alkoxy group, such as butoxylated melamine resins, methoxylated melamine resins, and the like. In the terms of compatibility of the resins, methoxylated melamine resins are preferred.

The thiol-series compound means an organic compound having a mercapto group (—SH). Specific examples thereof include pentaerythritol tetrakis(3-mercaptobutylate), 1,3,5-tris(3-mercaptobutyloxyethyl)-1,3,5-triazine-2,4,6(1H,3H,5H)-trione, butane diol bis(3-mercaptobutylate), butane diol bis(3-mercaptopentylate), 5-amino-1,3,4-amiothiadiazole-2-thiol, trimethylolpropane tris(3-mercaptobutylate), 5-methyl-1,3,4-thiadiazole-2-thiol, 2,5-dimercapto-1,3,4-thiadiazole, 2-amino-1,3,4-thiadiazole, 1,2,4-triazole-3-thiol, 3-amino-5-mercapt-1,2,4-triazole, and the like.

The content of the above-described additives is not particularly limited. However, the lower limit is preferably 0.05 parts by mass and more preferably 0.5 parts by mass, with respect to 100 parts by mass of the polyimide resin. Further, the upper limit is preferably 5 parts by mass and more preferably 3 parts by mass, with respect to 100 parts by mass of the polyimide resin.

In a case of an adhesion layer having a thickness of the range as described above, even when a defect occurred, a thickness of the film remaining at the side of a conductor (being free of defect) is ensured at the full. Therefore, an insulated wire having more reliability to insulation breakdown is prepared. In a case where an adhesion layer is too thin, an insulation breakdown voltage on the occasion of defect is remarkably lowered. On the other hand, in a case where an adhesion layer is too thick, since heat resistance of the adhesion layer is lower than the insulating layer, this raises concerns about deduction in heat resistance of the insulated wire itself.

(Film Thickness)

The film thickness (thickness of the film) of the adhesion layer is preferably from 10 to 90 μm, more preferably from 20 to 70 μm, and further more preferably from 30 to 50 μm.

<Insulating Layer>

In the present invention, an insulating layer is formed on the adhesion layer, whereby an insulating film prevented from breaking and occurrence of cracks can be formed.

The insulating layer may be composed of one layer or may have a laminate structure composed of more than one layer. The laminate structure composed of more than one layer is preferred because cracks are hard to occur.

In the present invention, a polyimide (PI) resin is used as a thermosetting resin which constitutes the insulating layer.

As the polyimide (PI) resin, those polyimide (PI) resins described in the adhesion layer are preferably used.

However, in the present invention, in the polyimide (PI) resin used in the insulating layer, the content rate of a total formula weight of an imide structure represented by Formula (a) in a polyimide resin skeleton is more than 27% and 37% or less If the content rate of a total formula weight of the above-described imide structure in the insulating layer is 27% or less, both solvent resistance and heat resistance are insufficient, whereas if the content rate is more than 37%, elongation characteristic in the insulating layer is lowered and heat resistance is also lowered.

It is preferred that the content rate of a total formula weight of the above-described imide structure in the insulating layer is greater than the content rate of the total formula weight of the imide structure of the adhesion layer.

Further, it is preferred that a difference in the content rate of the total formula weight of the above-described imide structure between the adhesion layer and the insulating layer is from 4.0 to 10.0%. By adjusting the content rate in this way, advantageous effects of the present invention are effectively achieved.

Note that, in a case where the insulating layer is composed of two or more layers, it is preferred that a difference in the content rate of the total formula weight of the above-described imide structure between the adhesion layer and an insulating layer placed furthest from the conductor is from 4.0 to 10.0%.

In the present invention, the insulating layer is preferably composed of two or more layers. In this case, a difference in the content rate of the total formula weight of the above-described imide structure between insulating layers lying next to each other is preferably from 2.5 to 10.0 and more preferably from 4.0 to 10.0%.

In the insulating layer, a variety of additives may be incorporated for any purpose.

Examples of these additives include a pigment, a cross-linker, a catalyst, and an antioxidant.

The content of these additives is preferably from 0.01 to 10 parts by mass with respect to 100 parts by mass of the resin which constitutes the insulating layer.

In the outermost layer of the insulating layer which covers a conductor used in the present invention, a self-lubricating resin conventionally prepared by dispersing and mixing a wax and a lubricant may be used.

As a wax, usually used materials may be used without any limitation. Examples thereof include: synthetic waxes such as polyethylene wax, petroleum wax, and a paraffin wax; and natural waxes such as carnauba wax, candelilla wax, and rice wax.

The lubricant may be also used without any limitation. Examples thereof include a silicone, a silicone macromonomer, a fluorine resin, and the like.

The film thickness of the insulating layer (the film thickness means a thickness of the film, and in a case of a laminate structure, it means a film thickness of the entire insulating layers) is preferably 20 μm or more, more preferably 25 to 80 μm, and further preferably 40 to 60 μm.

<Reinforcing Insulating Layer>

The reinforcing insulating layer may be composed of one layer, or may have a laminate structure of two or more layers.

The thermoplastic resin which constitutes the reinforcing insulating layer is not particularly limited. However, in the present invention, at least one resin selected from the group consisting of a polyetherether ketone (PEEK) resin and a polyphenylene sulfide (PPS) resin is preferred.

(Thermoplastic Resin)

Examples of the thermoplastic resin include: commodity engineering plastics such as polyamide (PA) (nylon), polyacetal (POM), polycarbonate (PC), polyphenylene ether (including a modified polyphenylene ether), polybutylene terephthalate (PBT), polyethylene terephthalate (PET), polyethylene naphthalate (PEN), and ultrahigh molecular weight polyethylene; and in addition, super engineering plastics such as polysulfone (PSF), polyether sulfone (PES), polyphenylene sulfide (PPS), polyarylate (U polymer), polyamide imide, polyether ketone (PEK), polyarylether ketone (PAEK), tetrafluoroethylene/ethylene copolymer (ETFE), polyether ether ketone (PEEK) (including a modified polyether ether ketone (modified PEEK)), tetrafluoroethylene/perfluoalkylvinylether copolymer (PFA), polytetrafluoroethylene (PTFE), a thermoplastic polyimide resin (TPI), polyamideimide (PAI), and a liquid crystal polyester; and further a polymer alloy composed of polyethylene terephthalate (PET) or polyethylene naphthalate (PEN) as a base resin, ABS/polycarbonate, NYLON 6,6, aromatic polyamide resin (aromatic PA), polymer alloys containing the foregoing engineering plastics such as polyphenylene ether/NYLON 6,6, polyphenylene ether/polystyrene, and polybutylene terephthalate/polycarbonate.

Thermoplastic resin may be crystalline or non-crystalline.

Further, the thermoplastic resin may be a single resin, or a mixture of two or more kinds of resins.

Among these thermoplastic resins, polysulfone (PSF), polyether sulfone (PES), polyphenylene sulfide (PPS), polyether ketone (PEK), polyarylether ketone (PAEK), and polyether ether ketone (PEEK) are preferred, and polyphenylene sulfide (PPS) and polyether ether ketone (PEEK) are more preferred from the viewpoint of solvent resistance.

Note that, of these thermoplastic resins, polyphenylene sulfide (PPS) is preferred in order to achieve a higher level of interlayer adhesion strength between the insulation layer composed of the thermosetting resin and the reinforcing insulating layer composed of the thermoplastic resin.

The reinforcing insulating layer is ordinarily formed by extrusion-molding, because a thermoplastic resin is used.

(Additives)

In the reinforcing insulating layer, various kinds of additives can be contained for any purpose.

Examples of such additives include those described in the insulating layer.

Of the reinforcing insulating layer, in an outermost reinforcing insulating layer, the waxes and the lubricants as described in the insulating layer are preferred.

The content of these additives is preferably from 0.01 to 10 parts by mass with respect to 100% parts by mass of the resin which constitutes the reinforcing insulating layer.

(Film Thickness)

The film thickness of the reinforcing insulating layer (the film thickness means a thickness of the film, and in a case of a laminate structure, it means a film thickness of the entire reinforcing insulating layers) is preferably 20 to 200 μm, more preferably 40 to 150 μm, and still more preferably 45 to 100 μm.

<<Method of Producing Insulated Wire>>

In the present invention, a thermosetting resin varnish is coated on the outer periphery of the conductor and then baked, to form an adhesion layer and an insulating layer. Further, if needed, a composition containing a thermoplastic resin is further formed on the insulating layer by an extrusion-molding to form a thermoplastic layer, whereby an insulated wire is produced.

The thermosetting resin varnish contains an organic solvent and the like so as to make the thermosetting resin be a varnish. The organic solvent is not particularly limited as long as the organic solvent does not inhibit the reaction of the thermosetting resin, and examples thereof include amide-based solvents such as N-methyl-2-pyrrolidone (NMP), N,N-dimethylacetamide (DMAC), and N,N-dimethylformamide; urea-based solvents such as N,N-dimethylethyleneurea, N,N-dimethylpropyleneurea, and tetramethylurea; lactone-based solvents such as γ-butyrolactone and γ-caprolactone; carbonate-based solvents such as propylene carbonate; ketone-based solvents such as methyl ethyl ketone, methyl isobutyl ketone, and cyclohexanone; ester-based solvents such as ethyl acetate, n-butyl acetate, butyl cellosolve acetate, butyl carbitol acetate, ethyl cellosolve acetate, and ethyl carbitol acetate; glyme-based solvents such as diglyme, triglyme, and tetraglyme; hydrocarbon-based solvents such as toluene, xylene, and cyclohexane; phenol-based solvents such as cresol, phenol, halogenated phenol; sulfone-based solvents such as sulfolane; and dimethylsulfoxide (DMSO).

Of these organic solvents, in view of high solubility, high reaction promotion properties and the like, amide-based solvents, and urea-based solvents are preferred; and in view of a solvent without a hydrogen atom that is apt to inhibit a crosslinking reaction due to heating, N-methyl-2-pyrrolidone (NMP), N,N-dimethylacetamide, N,N-dimethylethyleneurea, N,N-dimethylpropyleneurea, and tetramethylurea are preferred; and N,N-dimethylacetamide, N-methyl-2-pyrrolidone, N,N-dimethylformamide, and dimethylsulfoxide are particularly preferred.

Regarding the organic solvent and the like, one kind may be used alone, or two or more kinds may be used in mixture.

As a thermosetting resin varnish, commercially-available products may be used as mentioned above. In this case, since the thermosetting resin is dissolved in an organic solvent, the varnish contains the organic solvent.

The method of coating the thermosetting resin varnish may be in a usual manner. Examples of the coating method include a method of employing a die for a varnish coating, which has been manufactured so as to be similar to the shape of the conductor, and a method of employing a die that is called "universal die", which has been formed in a curb shape when the cross-section shape of the conductor is quadrangular.

The conductor having the thermosetting resin varnish coated thereon is baked by a baking furnace in a usual manner. Although specific baking conditions depend on the shape of a furnace to be used, in the case where the furnace is an about 8 m-sized vertical furnace by natural convection, the baking can be achieved by setting the passing time period to 10 to 90 sec at the furnace temperature of 400 to 650° C.

In a case of providing a thermoplastic resin layer on a thermosetting resin layer, for example, using a conductor having the thermosetting resin layer formed thereon (also called as an enamel wire) as a core wire, by extrusion-covering a composition containing a thermoplastic resin on the enamel wire using a screw extruder to thereby form the thermoplastic resin layer, an insulated wire can be obtained. On this occasion, the extrusion-covering of the thermoplastic resin layer is carried out using an extrusion die at temperature of melting point or higher of the thermoplastic resin so that the cross-sectional outer shape of the extrusion-covering resin layer has a similarity shape of the conductor and takes the shape by which a predetermined thickness of each of the side portion and the corner is obtained. The thermoplastic resin layer can be also formed by using a thermoplastic resin together with an organic solvent and the like.

In a case of using a non-crystalline resin, aside from the extrusion forming, the thermoplastic resin layer can be also formed by coating and baking a varnish of the non-crystalline resin having been dissolved in an organic solvent or the like on an enamel wire, using a die whose shape has the similarity in the shape of the conductor.

As the organic solvent for the thermoplastic resin varnish, organic solvents cited in the above-described thermosetting resin varnish are preferable.

Further, specific baking conditions depend on a shape of the furnace to be used. However, such conditions as described about the thermosetting resin are preferable.

<Characteristics of Insulated Wire>

The insulated wire of the present invention is excellent in terms of adhesiveness (conductor adhesiveness and interlayer adhesiveness) in addition to electric characteristics.

The adhesion strength between the conductor and the adhesion layer is preferably from 0.3 to 1.5 N/mm, more preferably from 0.4 to 1.0 N/mm, and still more preferably from 0.5 to 0.6 N/mm.

The interlayer adhesion strength between the adhesion layer and the insulating layer is preferably from 0.2 to 1.0 N/mm, more preferably from 0.3 to 0.8 N/mm, and still more preferably from 0.4 to 0.6 N/mm.

The interlayer adhesion strength in the insulating layers is preferably from 0.2 to 1.0 N/mm, more preferably from 0.3 to 0.8 N/mm, and still more preferably from 0.4 to 0.6 N/mm.

Further, in a case of having a reinforcing insulating layer, the interlayer adhesion strength between the insulating layer and the reinforcing insulating layer is preferably from 0.1 to 1.0 N/mm, more preferably from 0.2 to 0.8 N/mm, and still more preferably from 0.3 to 0.6 N/mm.

The above-described relation of the adhesion strength also constitutes a regulatory factor in the notched edgewise bending test (also including a test after subjecting a specimen to a major processing stress, or heating), as described below. This relation shows an excellent effect, for example, if there is a portion of relatively low adhesion strength in the outer layer side (outermost layer in particular).

The adhesion strength can be measured by a 180° peeling test or the like using a tensile tester, as shown in Examples.

Further, in the insulated wire of the present invention, it is preferred that, in the notched edgewise bending test using a previously scratched insulated wire as described below, even if the incision is expanded, the outermost layer remains at the rate of 50% or more of the original film thickness thereof.

Further, the insulated wire of the present invention shows excellent effects in terms of the fact that, in the above-described notched edgewise bending test, also in the case where a major processing stress, or heating is applied thereto as shown in Examples, even if the incision is expanded, the outermost layer remains at the rate of 50% or more of the original film thickness thereof.

<<Coil, and Electric or Electronic Equipment>>

The insulated wire of the present invention is applicable to a field which requires electric characteristics (resistance to voltage) and heat resistance, such as various kinds of electric or electronic equipment, as coil. For example, the insulated wire of the present invention is used for a motor, a transformer and the like, which can compose high-performance electric or electronic equipment. In particular, the insulated wire is preferably used as a winding wire for a driving motor of HV (Hybrid Vehicle) and EV (Electric Vehicle). In this way, electric or electronic equipment, particularly a driving motor of HV and EV, with the use of the insulated wire of the present invention as a coil can be provided. Note that, in the case where the insulated wire of the present invention is used for a motor coil, the insulated wire is also called as the insulated wire for a motor coil. In particular, the coil processed from the insulated wire of the present invention having the above-described excellent properties allows further miniaturization or high-performance of the electric or electronic equipment. Accordingly, the insulated wire of the present invention is preferably used as a winding wire for a recent driving motor of HV and EV, each of which is remarkable in miniaturization or high-performance.

The coil of the present invention is not particularly limited, as long as it has a form suitable for various kinds of electric or electronic equipment and examples thereof include items formed by a coil processing of the insulated wire of the present invention, and items formed by making an electrical connection of prescribed parts after subjecting the insulated wire of the present invention to a bending processing.

The coils formed by a coil processing of the insulated wire of the present invention are not particularly limited and examples thereof include a roll formed by spirally winding around a long insulated wire. In these coils, the number of winding wires of the insulated wire or the like is not particularly limited. Ordinarily, in winding around the insulated wire, an iron core or the like is used.

Example of the items formed by making an electrical connection of prescribed parts after subjecting the insulated wire of the present invention to a bending processing include coils used in a stator for rotating electrical machines or the like. Examples of these coils include a coil 33 (see FIG. 3) prepared by cutting the insulated wire of the present invention in a prescribed length, and then subjecting it to a bending processing in the U-shaped form or the like, thereby preparing a plurality of wire segments 34, and then alternately connecting two open ends (terminals) 34*a* in the U-shaped form or the like of each wire segment 34, as shown in FIG. 4.

The electric or electronic equipment formed by using this coil is not particularly limited and examples of one preferable embodiment of such electric or electronic equipment include a rotating electric machine equipped with a stator 30 shown in FIG. 3 (in particular, driving motors of HV and EV). This rotating electric machine can be made in the same constitution as the conventional one, except for equipment of the stator 30.

The stator 30 can be made in the same constitution as the conventional one, except for its wire segment 34 being formed by the insulated wire of the present invention. Specifically, the stator 30 has a stator core 31, and a coil 33 in which, as shown in such as FIGS. 3 and 4, wire segments 34 formed of the insulated wire of the present invention are incorporated in a slot 32 of the stator core 31 and open ends 34*a* of the wire segments 34 are electrically connected. Herein, the wire segment 34 may be incorporated in the slot 32 with one segment. However, it is preferable that as shown in FIG. 4, two segments are incorporated in pairs. In this stator 30, the coil 33 formed by alternately connecting the open ends 34*a* that are two ends of the wire segments 34 which have been subjected to a bending processing as described above, is incorporated in the slot 32 of the stator core 31. In this time, the wire segment 34 may be incorporated in the slot 32 after connecting the open ends 34*a* thereof. Alternatively, after incorporating the wire segment 34 in the slot 32, the open ends 34*a* of the wire segment 34 may be subjected to a bending processing, thereby to connect them.

In the insulated wire, the use of the conductor having a rectangular cross-sectional shape allows, for example, increase in a ratio (space factor) of the cross-sectional area of the conductor to the slot cross-sectional area of the stator core, whereby properties of the electric or electronic equipment can be improved.

The insulated wire of the present invention can be used as a coil in the field which requires electric properties (voltage resistance) and heat resistance, such as a rotating machine, and various kinds of electric or electronic equipment. For example, the insulated wire of the present invention is used for a motor, a transformer, and the like, by which a high-performance rotating machine and electric or electronic equipment can be constituted. In particular, the insulated wire is preferably used as a winding wire for a driving motor of the Hybrid Vehicle (HV) and the Electric Vehicle EV.

EXAMPLES

Hereinafter, the present invention will be described more in detail with reference to Examples, but the present invention is not limited thereto.

Hereinafter, the used materials are shown.

[Used Materials]

(Thermosetting Resin)

Polyimide (PI)

i) PMDA-ODA [Content rate of a total formula weight of an imide structure represented by Formula (a) (Content rate of total imide formula weight) 36.6%]

Polyimide obtained from pyromellitic acid dianhydride (PMDA) and 4,4'-diaminodiphenylether (4,4'-ODA); weight-average molecular weight: 30,000 ii) PMDA-BAPP [Content rate of total imide formula weight 23.%]

Polyimide obtained from pyromellitic acid dianhydride (PMDA) and 2,2-bis[4-(aminophenoxy)phenyl] propane (BAPP); weight-average molecular weight: 36,000 iii) PMDA-ODA/BAPP [Content rate of total imide formula weight 28.7%] Polyimide obtained from pyromellitic acid dianhydride (PMDA), 4,4'-diaminodiphenylether (4,4'-ODA) and 2,2-bis[4-(aminophenoxy)phenyl] propane (BAPP), weight-average molecular weight: 32,000 iii) PMDA-ODA/BAPP [Content rate of total imide formula weight 32.6%] weight-average molecular weight: 30,000 iv) PMDA-ODA/p-TPE [Content rate of total imide formula weight 31.0%] Polyimide obtained from pyromellitic acid dianhydride (PMDA), 4,4'-diaminodiphenylether (4,4'-ODA) and 1,4-bis(4-aminophenoxy)benzene (p-TPE), weight-average molecular weight: 25,000 v) PMDA-ODA/m-TPE [Content rate of total imide formula weight 29.5%] Polyimide obtained from pyromellitic acid dianhydride (PMDA), 4,4'-diaminodiphenylether (4,4'-ODA) and 1,3-bis(4-aminophenoxy)benzene (p-TPE), weight-average molecular weight: 25,000

Polyamideimide (PAI) manufactured by Hitachi Chemical Co., Ltd., trade name: HI406

(Thermoplastic Resin)

Polyetheretherketone (PEEK) manufactured by Solvay Specialty Polymers, trade name: KETASPIRE KT-820

Polyphenylene sulfide resin (PPS) manufactured by DIC Corporation, trade name: PPS FZ-2100

(Adhesion Layer Additives)

Melamine resin manufactured by Hitachi Chemical Company, Ltd., trade name: MELAN 265

Thiol-series compound manufactured by Toyobo Co., Ltd., trade name: THIADIAZOLES (MTD)

Example 1

In Example 1, an insulated wire 1 shown in FIG. 1 was prepared.

As the conductor 11, use was made of a cross-section rectangular (long side: 3.2 mm×short side: 1.5 mm, curvature radius r of chamfered edge at four corners=0.3 mm) rectangular conductor (copper having an oxygen content of 15 ppm).

In the formation of the adhesion layer, by coating a polyimide resin varnish containing 40 parts by mass of a

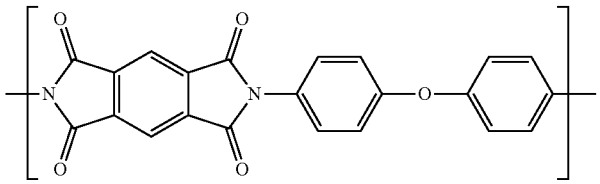

PMDA-ODA

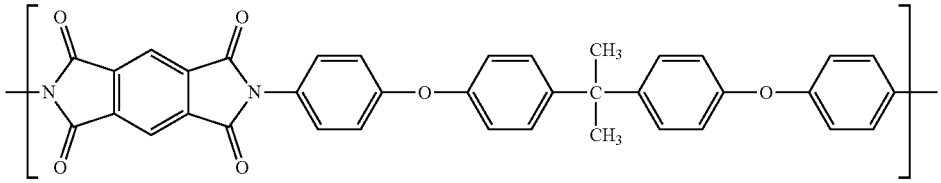

PMDA-BAPP

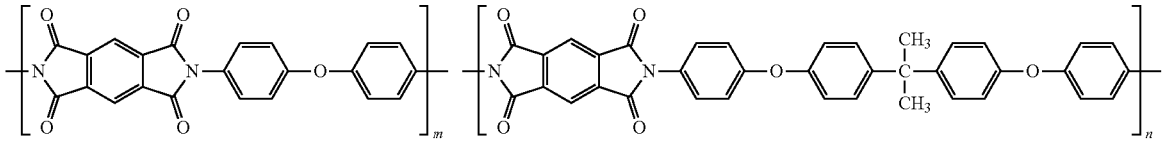

PMDA-ODA-BAPP

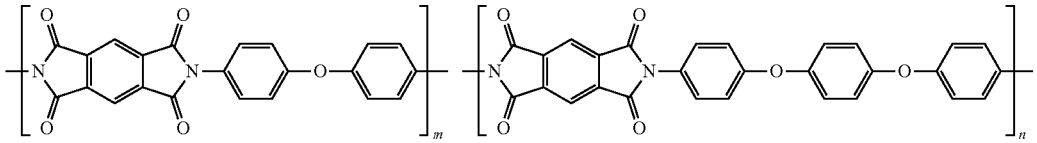

PMDA-ODA•p-TPE

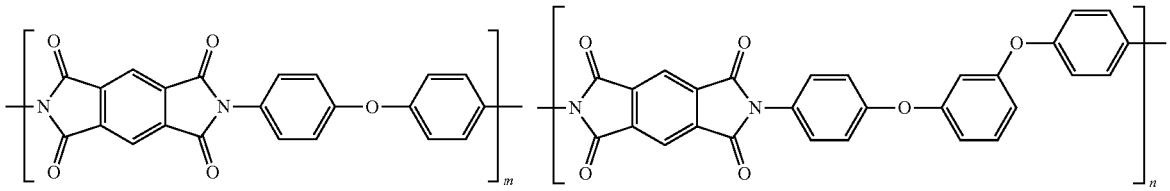

PMDA-ODA•m-TPE melamine resin with respect to 100 parts by mass of a polyimide resin in which the polyimide resin is derived from PMDA, ODA and BAPP as synthetic raw materials and the polyimide resin is such that the content rate of the total formula weight of an imide structure represented by Formula (a) (the content rate of the total imide formula weight) is 28.6%, on a conductor with a die having a similarity shape thereof, and then passing the coating through a 5 m-long baking furnace by natural convection whose inner temperature was set to a range of 300 to 500° C. at the speed so that the transit time was from 5 to 10 sec., and then repeating this procedure several times, a 40 μm-thick adhesion layer was formed. Further, for the insulating layer, as is the case with the adhesion layer, by coating and baking a polyimide resin varnish, in which the polyimide resin is derived from PMDA and ODA as synthetic raw materials and the polyimide resin is such that the content rate of the total imide formula weight is 36.6%, a 50 μm-thick insulating layer 1 was formed.

In this way, an insulated wire composed of the adhesion layer and one insulating layer provided on the conductor was produced.

Example 2

In Example 1, an insulated wire 1 shown in FIG. 1 was prepared.

An insulated wire composed of an adhesion layer and one insulating layer provided on a conductor was produced in the same manner as in Example 1, except to change the following items: the kind of the polyimide resin varnish and the content rate of the total imide formula weight used in each of the adhesion layer and the insulating layer 1; the kind and the amount of the additives added to the adhesion layer; and the film thickness of each of the adhesion layer and the insulating layer 1, as shown in Table 1.

Example 3

In Example 3, an insulated wire 1 shown in FIG. 1 was prepared.

An insulated wire composed of an adhesion layer and two insulating layers provided on a conductor was produced in the same manner as in Example 1, except to change the insulating layer to two layers (FIG. 5A), and also to change the following items: the kind of the polyimide resin varnish and the content rate of the total imide formula weight used in each of the adhesion layer, the insulating layer 1 and the insulating layer 2; the kind and the amount of the additives added to the adhesion layer; and the film thickness of each of the adhesion layer, the insulating layer 1 and the insulating layer 2, as shown in Table 1.

Example 4

In Example 4, an insulated wire 1 shown in FIG. 1 was prepared.

An insulated wire composed of an adhesion layer and two insulating layers provided on a conductor was produced in the same manner as in Example 1, except to change the insulating layer to two layers (FIG. 5A), and also to change the following items: the kind of the polyimide resin varnish and the content rate of the total imide formula weight used in each of the adhesion layer, the insulating layer 1 and the insulating layer 2; the kind and the amount of the additives added to the adhesion layer; and the film thickness of each of the adhesion layer, the insulating layer 1 and the insulating layer 2, as shown in Table 1.

Example 5

In Example 5, an insulated wire 1 shown in FIG. 1 was prepared.

Figure 5B:
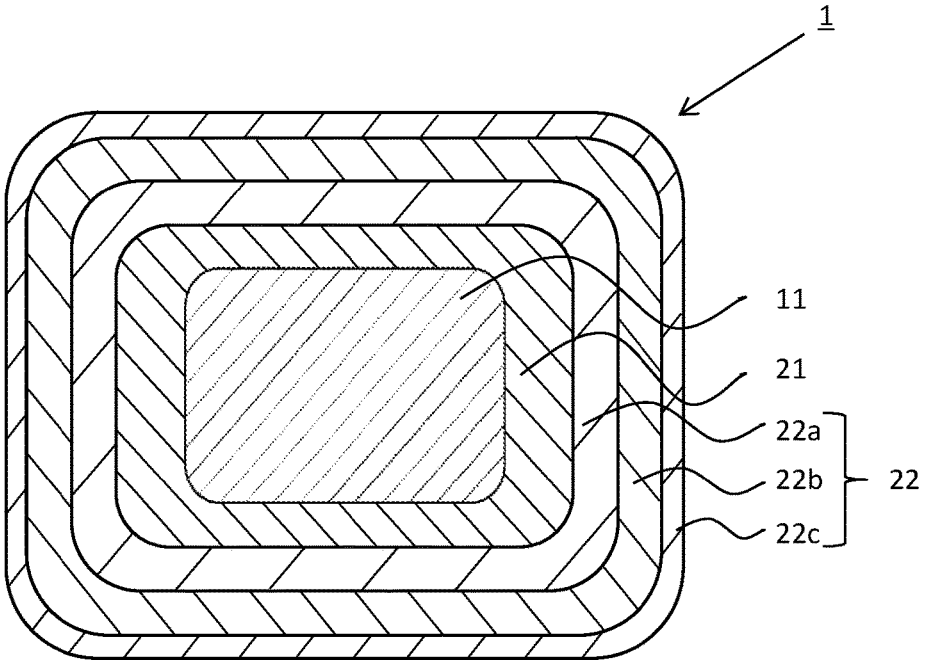

An insulated wire composed of an adhesion layer and three insulating layers provided on a conductor was produced in the same manner as in Example 1, except to change the insulating layer to three layers (FIG. 5B), and also to change the following items: the kind of the polyimide resin varnish and the content rate of the total imide formula weight used in each of the adhesion layer, the insulating layer 1, the insulating layer 2, and the insulating layer 3; the kind and the amount of the additives added to the adhesion layer; and the film thickness of each of the adhesion layer, the insulating layer 1, the insulating layer 2, and the insulating layer 3, as shown in Table 1.

Example 6

In Example 6, an insulated wire 2 shown in FIG. 2 was prepared.

An enamel wire composed of an adhesion layer and one insulating layer provided on a conductor was produced in the same manner as in Example 1, except to change the following items: the kind of the polyimide resin varnish and the content rate of the total imide formula weight used in each of the adhesion layer and the insulating layer 1; the kind and the amount of the additives added to the adhesion layer; and the film thickness of each of the adhesion layer and the insulating layer 1, as shown in Table 1.

With the obtained enamel wire as a core wire, a 60 μm-thick reinforcing insulating layer was formed on the outer side of the insulating layer using an extruder equipped with a 30 mm full flight screw (screw L/D=25, screw compression ratio=3). Herein, using polyetherether ketone (trade name: KETA SPIRE manufactured by Solvay Specialty Polymers) as a thermoplastic resin, the extrusion covering with the polyetherether ketone (PEEK) was performed using an extrusion die at 370° C. (temperature of the extrusion die) so that the outer cross-sectional shape of the reinforcing insulating layer has a similarity shape of the die.

In this way, an insulated wire (PEEK-extrusion-covered enamel wire) composed of the adhesion layer, one insulating layer and the reinforcing insulating layer provided on the conductor was produced.

Example 7

In Example 7, an insulated wire 2 shown in FIG. 2 was prepared.

An insulated wire (PPS-extrusion-covered enamel wire) composed of an adhesion layer, one insulating layer and a reinforcing insulating layer provided on a conductor was produced in the same manner as in Example 6, except to change the following items: the kind of the polyimide resin varnish and the content rate of the total imide formula weight used in each of the adhesion layer and the insulating layer 1; the kind and the amount of the additives added to the adhesion layer; the kind of the thermoplastic resin of the reinforcing insulating layer; and the film thickness of each of the adhesion layer, the insulating layer 1, and the reinforcing insulating layer, as shown in Table 1.

Example 8

In Example 8, an insulated wire 1 shown in FIG. 1 was prepared.

An insulated wire composed of an adhesion layer and one insulating layer provided on a conductor was produced in the same manner as in Example 1, except to change the following items: the kind of the polyimide resin varnish and the content rate of the total imide formula weight used in each of the adhesion layer and the insulating layer 1; the kind and the amount of the additives added to the adhesion layer; and the film thickness of each of the adhesion layer and the insulating layer 1, as shown in Table 1.

Comparative Example 1

In Comparative Example 1, an insulated wire 1 shown in FIG. 1 was prepared.

An insulated wire composed of an adhesion layer and one insulating layer provided on a conductor was produced in the same manner as in Example 1, except to use a polyamideimide resin as a resin of the adhesion layer, and also to use, in the insulating layer 1, the same as the polyamideimide resin used in the adhesion layer, and further to change the kind and the amount of the additives added to the adhesion layer; and the film thickness of each of the adhesion layer and the insulating layer 1, as shown in Table 2.

Comparative Example 2

In Comparative Example 2, an insulated wire 1 shown in FIG. 1 was prepared.

An insulated wire composed of an adhesion layer and one insulating layer provided on a conductor was produced in the same manner as in Example 1, except to change the following items: the kind of the polyimide resin varnish and the content rate of the total imide formula weight used in each of the adhesion layer and the insulating layer 1; the kind and the amount of the additives added to the adhesion layer; and the film thickness of each of the adhesion layer and the insulating layer 1, as shown in Table 2.

Comparative Example 3

In Comparative Example 3, an insulated wire 2 shown in FIG. 2 was prepared.

An insulated wire (PEEK-extrusion-covered enamel wire) composed of an adhesion layer, one insulating layer and a reinforcing insulating layer provided on a conductor was produced in the same manner as in Example 6, except to change the following items: the kind of the polyimide resin varnish and the content rate of the total imide formula weight used in each of the adhesion layer and the insulating layer 1; the kind and the amount of the additives added to the adhesion layer; the kind of the thermoplastic resin of the reinforcing insulating layer; and the film thickness of each of the adhesion layer, the insulating layer 1, and the reinforcing insulating layer, as shown in Table 2.

Comparative Example 4

In Comparative Example 4, an insulated wire 1 shown in FIG. 1 was prepared.

An insulated wire composed of an adhesion layer and one insulating layer provided on a conductor was produced in the same manner as in Example 1, except to change the following items: the kind of the polyimide resin varnish and the content rate of the total imide formula weight used in each of the adhesion layer and the insulating layer 1; the kind and the amount of the additives added to the adhesion layer; and the film thickness of each of the adhesion layer and the insulating layer 1, as shown in Table 2.

Comparative Example 5

In Comparative Example 5, an insulated wire 1 shown in FIG. 1 was prepared.

An insulated wire composed of an adhesion layer and one insulating layer provided on a conductor was produced in the same manner as in Example 1, except to change the following items: the kind of the polyimide resin varnish and the content rate of the total imide formula weight used in each of the adhesion layer and the insulating layer 1; the kind and the amount of the additives added to the adhesion layer; and the film thickness of each of the adhesion layer and the insulating layer 1, as shown in Table 2.

<Evaluation>

The adhesion strength of each of the obtained insulated wires was measured in the following manner. Further, evaluation was conducted by a notched edgewise bending test.

[Adhesion Strength]

In order to measure the interlayer or intralayer adhesion strength between the conductor and the adhesion layer; between the adhesion layer and the insulating layer 1; in the insulating layers 1; between the insulating layer 1 and the insulating layer 2; in the insulating layers 2; between the insulating layer 2 and the insulating layer 3; and between the insulating layer and the reinforcing insulating layer, the produced insulated wire was scratched so that the evaluand layer gets to an outermost layer.

Using a jig by which a cutter was connected to a micrometer, an incision having the width of 1 mm was made at length of 50 mm or more in the longitudinal direction. At this time, the adhesion strength can be measured by adjusting the incision to the depth to be required depending on the evaluand layer. From the thus-precut insulated wire, only the precut portion was peeled. The resultant insulated wire was set to a tensile tester (device name: "AUTOGRAPH AG-X", manufactured by Shimadzu Corporation), whereby the peeled portion was ripped upward at the rate of 4 mm/min (180° peeling). The value measured in this moment is red off.

Meanwhile, it is preferred that a portion having low adhesion strength is located at the outer layer side.

[Notched Edgewise Bending Test]

Edgewise bending means a method of bending the insulated wire with one of edge planes as an inner diameter plane, and also referred to as a method of bending the insulated wire in a crosswise direction. Here, "edge plane" means a plane in which short sides in a longitudinal cross section of a rectangular insulated wire are continuously formed in the axial direction, and "flat plane" means a plane in which long sides in a longitudinal cross section of a rectangular insulated wire are continuously formed in the axial direction.

A notched edgewise bending test is a test for evaluating an effect on preventing occurrence of cracks reaching the conductor caused by a mechanical stress that acts on the insulated wire during winding processing of the insulated wire and remains therein after processing, and the test was conducted in accordance with "coiling test" specified in JIS C 3216-3: 2011.

In addition, in order to apply severer conditions, the edgewise bending test was conducted by making one 5

μm-deep incision on an edge plane in an outermost layer of each insulated wire in a peripheral direction (direction perpendicular to an axis line of the insulated wire) as a whole by using a feather razor blade S single edge (manufactured by Feather Safety Razor Co., Ltd.). Subsequently, an edge plane on a side opposite to the incised edge plane was applied to a 1.5 mm bar made of stainless steel (SUS), and the insulated wire was coiled on the bar in such a manner that the incision was directed toward an outside and a length direction of the incision was along an axis line of the bar. After elapse of 1 hour, the incision on the insulated wire was visually observed in a state in which the insulated wire was coiled, and judgement was made depending on criteria described below.

Note that the above evaluation was also conducted with respect to each of the insulated wires which were left to stand in a high temperature bath set to 200° C. for 500 hours, and this evaluation was designated as "Post-heat resistance test" in Tables 1 and 2.

Evaluation Criterion

A: A case where the incision was broadened and the outermost layer was held at the rate of 80% with respect to the original film thickness thereof.

B: A case where the incision was broadened and the outermost layer was held at the rate of 50% with respect to the original film thickness thereof.

C: A case where the incision was broadened and the outermost layer was held at the rate of 15% with respect to the original film thickness thereof.

D: A case where the incision reached the conductor and the conductor was exposed.

The obtained results are shown together in Tables 1 and 2.

Herein, the expression "–" indicates that the material was not in use, or that the value was 0 (zero), or that since the evaluand layer was non-existent, it was not evaluated.

TABLE 1

| | | | Example 1 | Example 2 | Example 3 | Example 4 |
|---|---|---|---|---|---|---|
| | Adhesion layer | Kind of resin | PI (PMDA-ODA•BAPP) | PI (PMDA-ODA•BAPP) | PI (PMDA-ODA•m-TPE) | PI (PMDA-ODA•BAPP) |
| | | Film thickness (μm) | 40 | 40 | 40 | 25 |
| | | Additive for adhesion layer | Melamine resin | Melamine resin | Melamine resin | Melamine resin |
| | | Addition amount of additive (part by mass) | 1 | 2 | 1 | 1 |
| | | Content rate of the total imide formula weight (%) | 28.7 | 32.6 | 29.5 | 32.6 |
| Insulating layer | Insulating layer 1 | Kind of resin | PI (PMDA-ODA) | PI (PMDA-ODA) | PI (PMDA-ODA•BAPP) | PI (PMDA-ODA•BAPP) |
| | | Film thickness (μm) | 50 | 50 | 25 | 25 |
| | | Content rate of the total imide formula weight (%) | 36.6 | 36.6 | 32.6 | 28.7 |
| | Insulating layer 2 | Kind of resin | — | — | PI (PMDA-ODA) | PI (PMDA-ODA) |
| | | Film thickness (μm) | — | — | 25 | 25 |
| | | Content rate of the total imide formula weight (%) | — | — | 36.6 | 36.6 |
| | Insulating layer 3 | Kind of resin | — | — | — | — |
| | | Film thickness (μm) | — | — | — | — |
| | | Content rate of the total imide formula weight (%) | — | — | — | — |
| | Reinforcing insulating layer | Kind of resin | — | — | — | — |
| | | Film thickness (μm) | — | — | — | — |
| Evaluation of adhesion strength | Adhesion strength between conductor and adhesion layer (N/mm) | | 0.52 | 0.51 | 0.51 | 0.55 |
| | Interlayer adhesion strength between adhesion layer and insulating layer 1 (N/mm) | | 0.50 | 0.37 | 0.73 | 0.80 |
| | Intralayer adhesion strength in insulating layers 1 (N/mm) | | 0.20 | 0.20 | 0.80 | 0.90 |
| | Interlayer adhesion strength between insulating layer 1 and insulating layer 2 (N/mm) | | — | — | 0.37 | 0.55 |
| | Intralayer adhesion strength in insulating layers 2 (N/mm) | | — | — | 0.20 | 0.20 |
| | Interlayer adhesion strength between insulating layer 2 and insulating layer 3 (N/mm) | | — | — | — | — |
| | Interlayer adhesion strength between insulating layer and reinforcing insulating layer (N/mm) | | — | — | — | — |
| Evaluation of performance | Notched edgewise bending | | B | B | A | B |
| | Post-heat resistance test | | B | B | B | B |

| | | | Example 5 | Example 6 | Example 7 | Example 8 |
|---|---|---|---|---|---|---|
| | Adhesion layer | Kind of resin | PI (PMDA-ODA•BAPP) | PI (PMDA-ODA•p-TPE) | PI (PMDA-ODA•p-TPE) | PI (PMDA-ODA•BAPP) |
| | | Film thickness (μm) | 20 | 30 | 20 | 10 |
| | | Additive for adhesion layer | Melamine resin | Thiol-series compound | Thiol-series compound | Melamine resin |
| | | Addition amount of additive (part by mass) | 1 | 1 | 1 | 1 |
| | | Content rate of the total imide formula weight (%) | 28.7 | 31 | 31 | 28.7 |

TABLE 1-continued

| | | | | | | |
|---|---|---|---|---|---|---|
| Insulating layer | Insulating layer 1 | Kind of resin | PI (PMDA-ODA•BAPP) | PI (PMDA-ODA) | PI (PMDA-ODA) | PI (PMDA-ODA) |
| | | Film thickness (μm) | 25 | 50 | 50 | 30 |
| | | Content rate of the total imide formula weight (%) | 30.0 | 36.6 | 36.6 | 36.6 |
| | Insulating layer 2 | Kind of resin | PI (PMDA-ODA•BAPP) | — | — | — |
| | | Film thickness (μm) | 25 | — | — | — |
| | | Content rate of the total imide formula weight (%) | 32.6 | — | — | — |
| | Insulating layer 3 | Kind of resin | PI (PMDA-ODA) | — | — | — |
| | | Film thickness (μm) | 25 | — | — | — |
| | | Content rate of the total imide formula weight (%) | 36.6 | — | — | — |
| | Reinforcing insulating layer | Kind of resin | — | PEEK | PPS | — |
| | | Film thickness (μm) | — | 60 | 60 | — |
| Evaluation of adhesion strength | Adhesion strength between conductor and adhesion layer (N/mm) | | 0.52 | 0.90 | 0.90 | 0.52 |
| | Interlayer adhesion strength between adhesion layer and insulating layer 1 (N/mm) | | 0.90 | 0.40 | 0.40 | 0.50 |
| | Intralayer adhesion strength in insulating layers 1 (N/mm) | | 0.85 | 0.20 | 0.20 | 0.20 |
| | Interlayer adhesion strength between insulating layer 1 and insulating layer 2 (N/mm) | | 0.88 | — | — | — |
| | Intralayer adhesion strength in insulating layers 2 (N/mm) | | 0.60 | — | — | — |
| | Interlayer adhesion strength between insulating layer 2 and insulating layer 3 (N/mm) | | 0.38 | — | — | — |
| | Interlayer adhesion strength between insulating layer and reinforcing insulating layer (N/mm) | | — | 0.10 | 0.10 | — |
| Evaluation of performance | Notched edgewise bending | | B | A | A | A |
| | Post-heat resistance test | | B | A | B | B |

TABLE 2

| | | | Comparative Example 1 | Comparative Example 2 | Comparative Example 3 | Comparative Example 4 | Comparative Example 5 |
|---|---|---|---|---|---|---|---|
| Adhesion layer | | Kind of resin | PAI | PI (PMDA-BAPP) | PI (PMDA-BAPP) | PI (PMDA-ODA•BAPP) | PI (PMDA-ODA) |
| | | Film thickness (μm) | 40 | 20 | 30 | 20 | 40 |
| | | Additive for adhesion layer | Melamine resin | Melamine resin | Melamine resin | Melamine resin | Melamine resin |
| | | Addition amount of additive (part by mass) | 1 | 2 | 2 | 1 | 1 |
| | | Content rate of the total imide formula weight (%) | — | 23.6 | 23.6 | 28.7 | 36.6 |
| Insulating layer | Insulating layer 1 | Kind of resin | PAI | PI (PMDA-ODA) | PI (PMDA-ODA) | PI (PMDA-BAPP) | PI (PMDA-ODA•BAPP) |
| | | Film thickness (μm) | 30 | 50 | 30 | 30 | 50 |
| | | Content rate of the total imide formula weight (%) | — | 36.6 | 36.6 | 23.6 | 28.7 |
| | Insulating layer 2 | Kind of resin | — | — | — | — | — |
| | | Film thickness (μm) | — | — | — | — | — |
| | | Content rate of the total imide formula weight (%) | — | — | — | — | — |
| Reinforcing insulating layer | | Kind of resin | — | — | PEEK | — | — |
| | | Film thickness (μm) | — | — | 60 | — | — |
| Evaluation of adhesion strength | Adhesion strength between conductor and adhesion layer (N/mm) | | 0.60 | 0.15 | 0.15 | 0.52 | 1.00 |
| | Interlayer adhesion strength between adhesion layer and insulating layer 1 (N/mm) | | 1.20 | 0.80 | 0.80 | 1.20 | 0.50 |
| | Intralayer adhesion strength in insulating layers 1 (N/mm) | | 1.20 | 0.20 | 0.20 | 1.30 | 0.90 |
| | Interlayer adhesion strength between insulating layer 1 and insulating layer 2 (N/mm) | | — | — | — | — | — |
| | Intralayer adhesion strength in insulating layers 2 (N/mm) | | — | — | — | — | — |
| | Interlayer adhesion strength | | — | — | — | — | — |

TABLE 2-continued

| | | | | | | |
|---|---|---|---|---|---|---|
| | between insulating layer 2 and insulating layer 3 (N/mm) | | | | | |
| | Interlayer adhesion strength between insulating layer and reinforcing insulating layer (N/mm) | — | — | 0.1 | — | — |
| Evaluation of performance | Notched edgewise bending | D | C | D | C | D |
| | Post-heat resistance test | D | D | D | D | D |

The above Tables 1 and 2 showed that when compared with Comparative Examples 1 to 5, the insulated wires of Examples 1 to 8, each of which was designed to have a constitution of the present invention, achieved superior effects in terms of adhesion strength between the conductor and the adhesion layer, and interlayer adhesion strength between each of layers, and also a superior effect in the terms of the fact that the incision was broadened, and the outermost layer was held at the rate of at least 50% with respect to the original film thickness thereof in the notched edgewise bending test. Furthermore, as is apparent from the results of the edgewise bending test in accordance with the post-heat resistance test, it is found that the insulated wires of the present invention, even if subjected to a major processing stress or heating, cause less insulation defect that can generate an insulation failure in the film, and have high reliability.

From the above-described results, it is found that the insulated wire of the present invention can be preferably used as a coil in the field which requires electrical properties (voltage resistance) or a heat resistance, such as a rotating machine and various kinds of electric or electronic equipment, particularly as a coil for a motor, a transformer, and the like, and as a winding wire for driving motors of the hybrid vehicle (HV) and the electric vehicle EV.

Having described our invention as related to this embodiment, it is our intention that the invention not be limited by any of the details of the description, unless otherwise specified, but rather be construed broadly within its spirit and scope as set out in the accompanying claims.

DESCRIPTION OF SYMBOLS

1, 2 Insulated wire
11 Conductor
21 Adhesion layer
22 Insulating layer
23 Reinforcing insulating layer
30 Stator
31 Stator core
32 Slot
33 Coil
34 Wire segment

The invention claimed is:

1. An insulated wire, comprising:

a conductor;

an adhesion layer composed of a polyimide resin, which is provided in direct contact with the conductor; and an insulating layer with a film thickness of 20 μm or more, composed of a polyimide resin, which is provided on the adhesion layer, wherein, in the adhesion layer, the content rate of a total formula weight of an imide structure represented by Formula (a) in a polyimide resin skeleton is 27% or more and 33% or less;

wherein, in the polyimide resin of the insulating layer, the content rate of a total formula weight of the imide structure in a polyimide resin skeleton is more than 27% and 37% or less:

Formula (a)

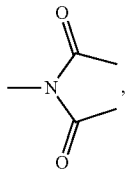

and wherein the insulating layer is composed of two or more layers, and a difference in the content rate of the total formula weight of the imide structure between insulating layers adjacent to each other is from 4.0 to 10.0%.

2. The insulated wire according to claim 1, wherein a difference in the content rate of the total formula weight of the imide structure between the adhesion layer and the insulating layer is from 4.0 to 10.0%.

3. The insulated wire according to claim 1, wherein a difference in the content rate of the total formula weight of the imide structure between the adhesion layer and the insulating layer is from 4.0 to 10.0%, and the content rate of the total formula weight of the insulating layer is greater than the adhesion layer.

4. The insulated wire according to claim 1, wherein the polyimide resin has a partial structure represented by Formula (1):

Formula (1)

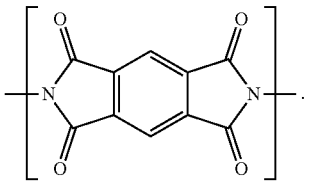

5. The insulated wire according to claim 1, further comprising a reinforcing insulating layer composed of a thermoplastic resin, wherein the thermoplastic resin contains at least one kind of resin selected from a polyetherether ketone resin and a polyphenylene sulfide resin.

6. A coil, which is obtained by winding working the insulated wire according to claim 1.

7. An electric or electronic equipment, comprising the coil according to claim 6.

* * * * *